United States Patent [19]

Nishimura et al.

[11] Patent Number: 5,030,299

[45] Date of Patent: Jul. 9, 1991

[54] LOW EXPANSION CAST IRON LAPPING TOOL

[75] Inventors: Takanobu Nishimura; Motoo Suzuki; Tastuyoshi Aisaka, all of Kanagawa, Japan

[73] Assignee: Kabushiki Kaisha Toshiba, Kawasaki, Japan

[21] Appl. No.: 501,319

[22] Filed: Mar. 14, 1990

Related U.S. Application Data

[62] Division of Ser. No. 262,784, Oct. 26, 1988, abandoned.

[30] Foreign Application Priority Data

Oct. 26, 1987 [JP] Japan ..... 62-268249

[51] Int. Cl.[5] ..... C22C 37/00

[52] U.S. Cl. ..... 148/321; 420/95; 420/27; 51/293; 51/DIG. 6; 148/905

[58] Field of Search ..... 148/321, 905; 420/27, 420/10, 95; 51/293, DIG. 6

[56] References Cited

FOREIGN PATENT DOCUMENTS 58-210149 12/1983 Japan ..... 420/27

63-183151 7/1988 Japan .

*Primary Examiner*—Deborah Yee

*Attorney, Agent, or Firm*—Oblon, Spivak, McClelland, Maier & Neustadt

[57] ABSTRACT

A lapping tool with a flatness in the range below 20 μm which is made of at least cast iron having an austenitic matrix and consisting essentially of from 1% up to 3.5% carbon, up to 1.5% silicon, from 32% to 39.5% nickel, from 1% to less than 4% cobalt, up to 41% of the combined total of nickel plus cobalt and the balance substantially all iron providing a low expansion coefficient, good castability, good cutting properties and good damping capacity. (By % is meant % by weight).

9 Claims, 4 Drawing Sheets

LOW EXPANSION CAST IRON LAPPING TOOL

This application is a Division of application Ser. No. 07/262,784, filed on Oct. 26, 1988, now abandoned.

BACKGROUND OF THE INVENTION

This invention relates to low expansion cast iron having an austenitic matrix.

Recently, higher accuracy has become more important for tools and apparatus in the field of electronics, such as machine tools, measuring apparatus and metallic molds, as the field of electronics has been further developed. For example, materials having a coefficient of expansion of at most $4\times10^{-6}/°$ C. have been demanded for precision instruments.

As a result, some such materials have been developed. These include Invar cast iron (36.5 wt % Ni-Fe cast iron) and Ni-Resist (cast iron of ASTM A439 type D-5), as shown in Table 1.

TABLE 1

| | Composition (wt %) | | | | | | Thermal expansion coefficient |
|---|---|---|---|---|---|---|---|
| | C | Si | Mn | Ni | Cr | Fe | (20-200° C.) × $10^{-6}$/°C. |
| Ni-Resist (ASTM A439) | <2.40 | 1.0 2.80 | <1.00 | 34.00 36.00 | <0.10 | balance | 5 |
| Invar | — | — | — | 36.5 | — | balance | 1.2 |

Invar cast iron has a thermal expansion coefficient of $1.2\times10^{-6}/°$ C., which is a very low coefficient. However, Invar cast iron has a poor castability and is difficult to cut. Thus, its applications are limited.

On the other hand, Ni-Resist has good castability and is easily cut. However, it has a thermal expansion coefficient of about $5\times10^{-6}/°$ C., which is too high for precision instruments. Accordingly, it cannot meet current demands very well.

Attempts have been made to produce a material which has:

(1) an expansion coefficient not greater than $4\times10^{-6}/°$ C., and (2) good castability, good cutting properties and good damping capacity.

However, such a material has not been successfully achieved prior to the present invention.

SUMMARY OF THE INVENTION

Accordingly, it is an object of the present invention to provide a material which has both an expansion coefficient not greater than $4\times10^{-6}/°$ C., and good castability, favorable cutting properties and satisfactory damping capacity.

The present inventors discovered austenitic cast iron consisting essentially of carbon of about 1% to 3.5% by weight, silicon of about 1.5% maximum by weight, nickel of about 32% to 39.5% by weight, cobalt of from 1% to less than 4% by weight, the nickel and the cobalt being present in total amount not greater than 41% by weight, and the balance being substantially all iron. This material has both an expansion coefficient not greater than $4\times10^{-6}/°$ C., and good castability, cutting properties and damping capacity.

DESCRIPTION OF THE PREFERRED EMBODIMENTS

Figure 1:
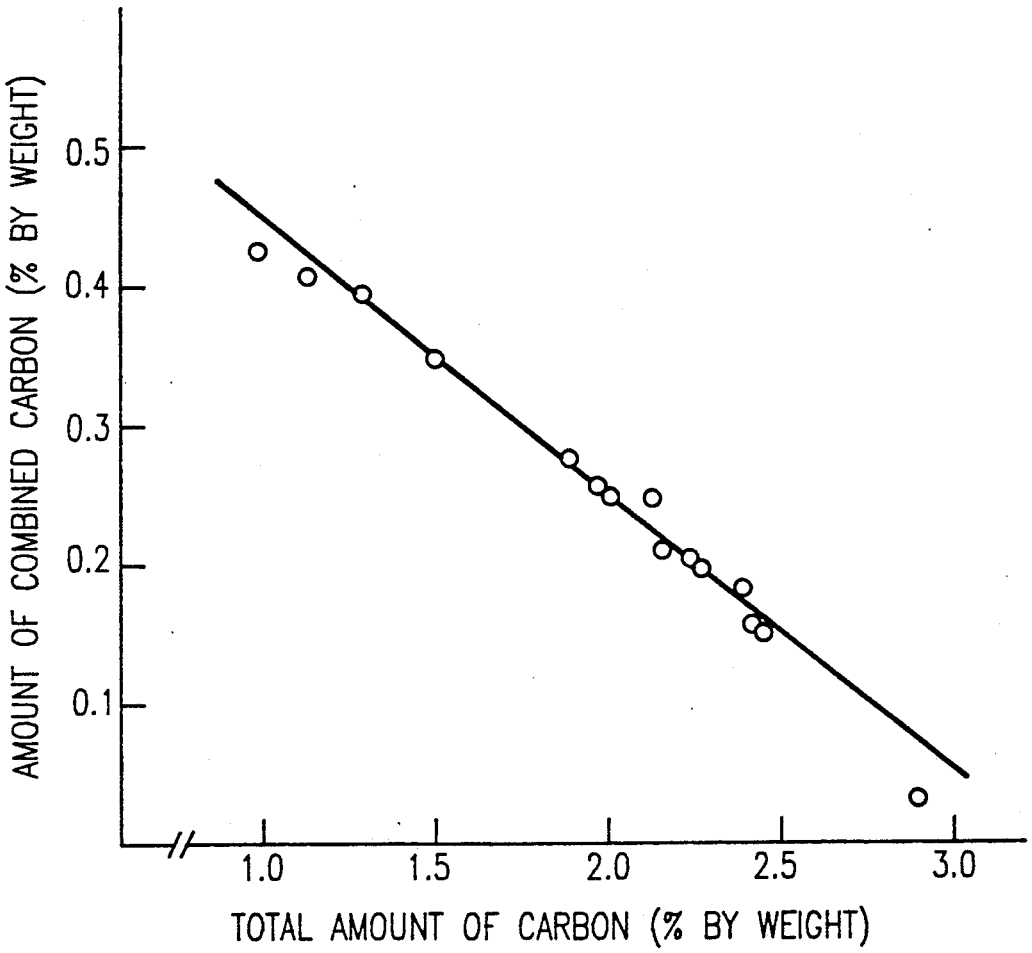
FIG. 1 is a graph showing the relation between the amount of combined carbon and the total amount of carbon added into a cast iron which includes nickel in the range of from 33 wt % to 40 wt %.

Reference will now make in detail to the present preferred embodiment of the invention. In accordance with the invention, the cast iron has an austenitic matrix and consists essentially of carbon of about 1% to 3.5% by weight, silicon of about 1.5% maximum by weight, nickel of about 32% to 39.5% by weight, cobalt of from 1% to less than 4% by weight, the nickel and the cobalt being present in total amount not greater than 41% by weight, and the balance being substantially all iron.

The results of a number of experiments and analyses will be explained below. The following equations (1) and (2) concerning the relations between thermal expansion coefficient and specified elements are applicable.

$$\text{Thermal expansion coefficient } (\times 10^{-6}/°\text{C.}) = 14.905 + 0.1 \times [\text{amount of combined carbon}]\ (\%) + 1.49 \times [\text{amount of silicon}]\ (\%) - 0.32 \times [\text{amount of nickel}]\ (\%) - 0.70 \times [\text{amount of cobalt}]\ (\%) + 1.35 \times [\text{amount of manganese}]\ (\%) \quad (1)$$

$$\text{Thermal expansion coefficient } (\times 10^{-6}/°\text{C.}) = -2.14 + 1.75 \times [\text{amount of combined carbon}]\ (\%) + 2.11 \times [\text{amount of silicon}]\ (\%) + 0.14 \times [\text{amount of nickel}]\ (\%) + 0.28 \times [\text{amount of cobalt}]\ (\%) + 0.25 \times [\text{amount of manganese}]\ (\%) \quad (2)$$

The equation (1) comes from Multiple Regression analysis of the relation between thermal expansion coefficient and the specified elements for amounts of nickel less than the amount corresponding to the lowest expansion coefficient.

On the other hand, equation (2) comes from Multiple Regression analysis of the relation between the thermal expansion coefficient and specified elements for amounts of nickel greater than the amount corresponding to the lowest expansion coefficient.

Figure 2:
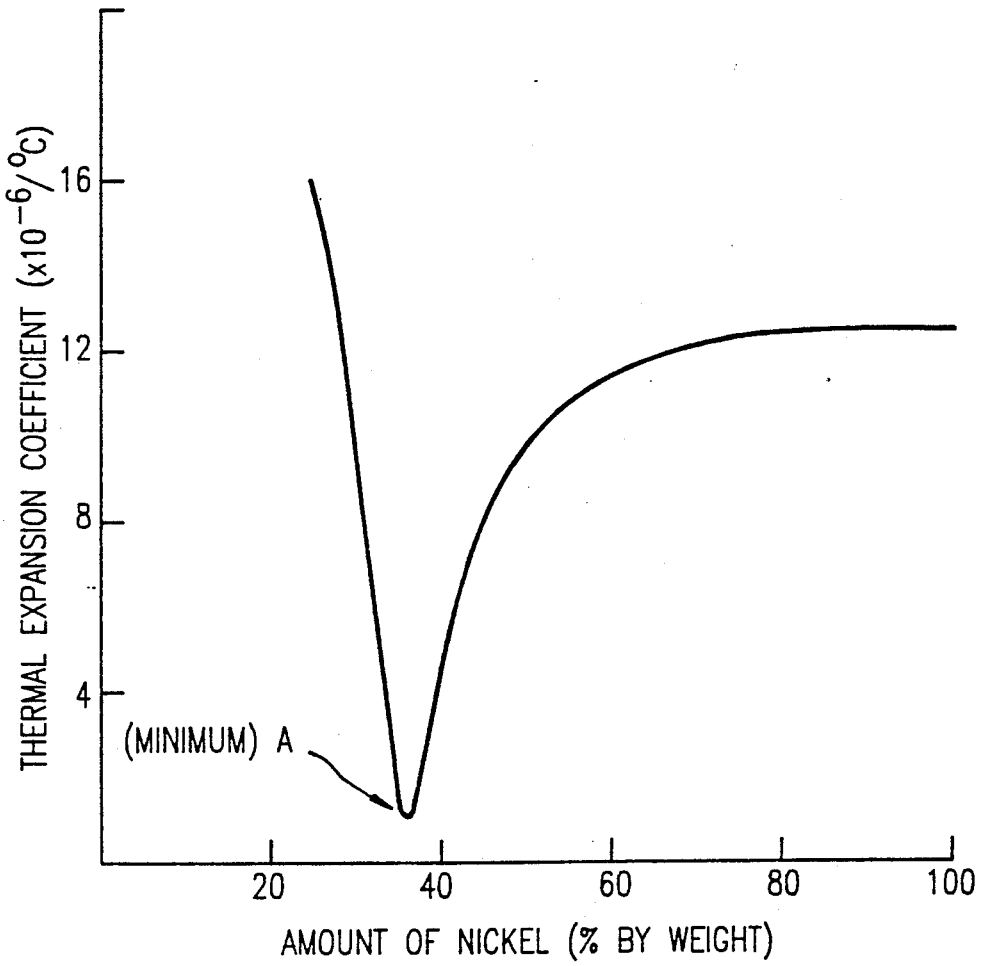
FIG. 2 is a graph showing the relation between the thermal expansion coefficient of Fe-Ni alloy and the amount of nickel of the Fe-Ni alloy.

That is to say, there is a relation between the thermal expansion coefficient of Ni-Fe alloy and the amount of nickel in that alloy, as shown in FIG. 2. This figure shows that this type of alloy has a minimum thermal expansion coefficient at about 36 wt % of nickel. The equation (1) shows the relation between thermal expansion coefficient and specified elements on lower side of the amount of nickel corresponding to the minimum thermal expansion coefficient. The equation (2) shows the relation between thermal expansion coefficient and specified elements on the higher side of the amount of nickel corresponding to the minimum thermal expansion coefficient. From these equations, it has been determined that the thermal expansion depends greatly on the amount of silicon. This is because the coefficient of silicon is the largest value among all the specified elements. Accordingly, it was determined that decreasing the amount of silicon provides a lower expansion coefficicent.

With regard to carbon in the equations (1) and (2), the inventors found for the first time that thermal expansion does not directly depend on the total amount of carbon, but directly depends on the amount of combined carbon. That is to say, it had been known prior to this invention that thermal expansion depends partially on the total amount of carbon.

Figure 3:
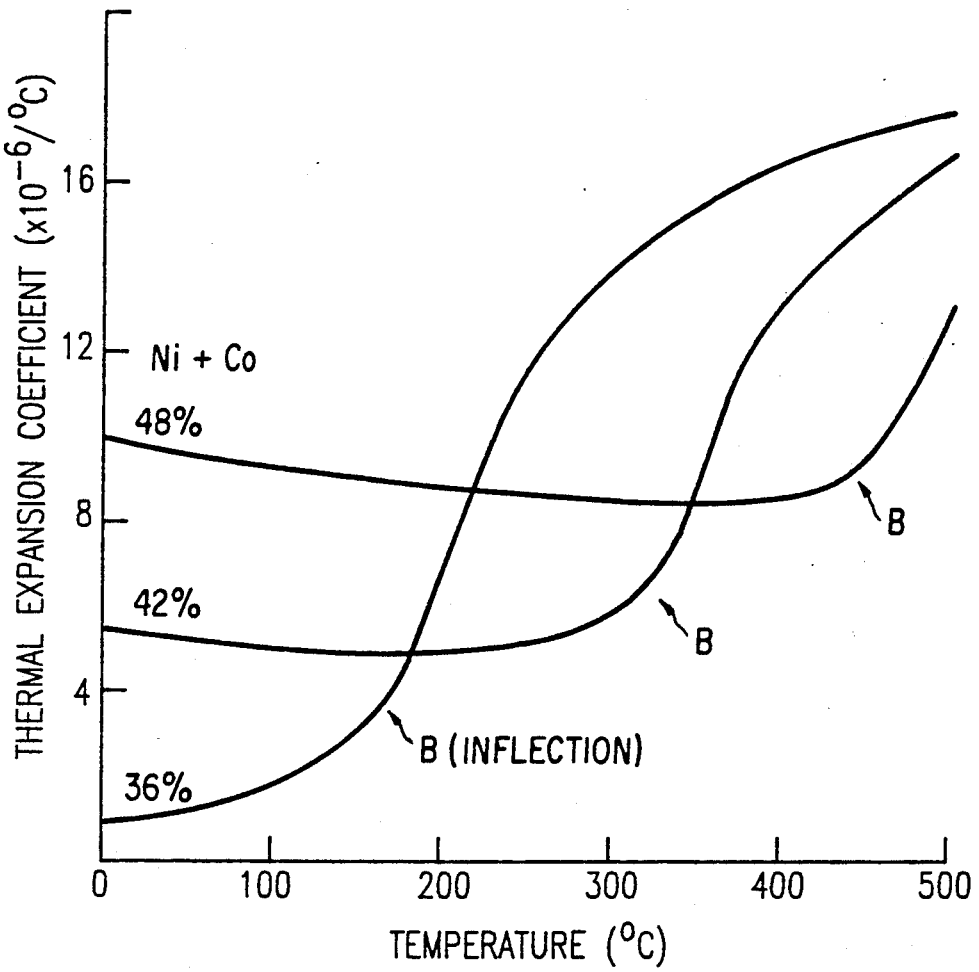
FIG. 3 is a graph showing the relation between the thermal expansion coefficient and the inflection temperature when the amount of nickel and cobalt is changed.

A second discovery is that inflection temperature of the cast iron changes with changes in the total amount of nickel and cobalt in the cast iron. FIG. 3 is a graph which shows the temperature versus thermal expansion coefficient relation. As shown in FIG. 3, the cast iron has high thermal expansion coefficient in the range from room temperature to 200° C. where the amounts of nickel and cobalt increase in the cast iron. Hence, if the inflection temperature is below 325° C., preferably in the range from 200° to 250° C., the cast iron can have a lower thermal expansion coefficient in the range of room temperature to 200° C.

Equation (3) shows the relation between inflection temperature and specified elements.

$$\text{inflection temperature} = 22.5 \times [\text{amount of nickel and cobalt}]\ (\%) - 22 \times [\text{amount of manganese}]\ (\%) - 600.3 \quad (3)$$

From this equation, it can be understood that the inflection temperature can be reduced by adding manganese.

A third result is that good castability, good cutting properties and good damping capacity can be obtained by decreasing the amount of combined carbon and the amount of carbide precipitated in the matrix of the cast iron. There are three forms of carbon in cast iron. One of them is combined carbon. Another of them is graphite. Another of them is carbide. It has been found that as the amount of graphite decreases in the matrix of cast iron, worse castability, poorer cutting properties and worse damping capability may be obtained. It has been found that as the amount of carbide increases in the matrix of cast iron, micropores are formed and cutting properties are reduced. Hence, it is important to increase the amount of graphite and to decrease the amount of carbide and combined carbide.

Equations (4), (5), (6) and (7) show the relation between the amount of combined carbon and mechanical properties.

$$\text{Tensile strength (kgf/mm}^2) = 19.6 + 93[\text{amount of combined carbon}](\%) \quad (4)$$

$$\text{Proof stress (kgf/mm}^2) = -4.8 + 135.5[\text{amount of combined carbon}](\%) \quad (5)$$

$$\text{Young's modulus (kgf/mm}^2) = 69825 + 197500[\text{amount of combined carbon}](\%) \quad (6)$$

$$\text{Hardness (HB)} = 128.6 + 133[\text{amount of combined carbon}](\%) \quad (7)$$

From these equations, it has been understood that mechanical properties can be improved by increasing the amount combined carbon.

FIG. 1 shows the relation between the amount of combined carbon and the total amount of carbon added in cast iron. That is to say, it shows that the amount of combined carbon gets smaller, as the amount of carbon gets larger.

FIG. 1 is represented by equation (8).

$$[\text{amount of combined carbon}]\ (\%) = 0.65 - 0.20\ [\text{amount of carbon added into cast iron}]\ (\%) \quad (8)$$

The relations between the properties in equations (1) through (7) and the amount of carbon added in the cast iron can be obtained by using equation (8).

The proper amounts of each element have been determined from the results described above. Hereinafter, the amounts of each element and the reasons for limitation of the amounts of each element will be described.

At first, the desired amount of carbon is from about 1 wt % to 3.5 wt %. If the amount of carbon is increased too much, the amount of combined carbon decreases and castability, cutting properties and damping capacity are adversely effected. On the other hand, if the amount of carbon is decreased too much, the thermal expansion coefficient increases. For this reason, the amount of carbon should be maintained from about 1 wt % to 3.5 wt %, and preferably from 1.5 wt % to 3 wt %. More preferably, the carbon range is from 2.2 wt % to 2.3 wt %.

Secondly, the amount of silicon should be at most about 1.5 wt %. If the amount of silicon is increased too much, the thermal expansion coefficient increases. On the other hand, silicon acts as an inoculant for making crystallization of graphite increase. In this case, it has been found that an adequate amount of graphite for good castability and good cutting properties can be obtained when the amount of nickel is from about 32 wt % to 39.5 wt %, even though the amount of silicon is below 0.6 wt %. For this reason, the amount of silicon should be at most 1.5 wt % and preferably less than 1 wt %. Furthermore, if a lower limitation of the amount of silicon is maintained, it should be greater than 0.3 wt %.

The amount of nickel should be from 32 wt % to 39.5 wt %. If the amount of nickel is increased too much, the thermal expansion coefficient increases. On the other hand, if the amount of nickel is decreased too much, the thermal expansion coefficient also increases. For this reason, the amount of nickel should be from about 32 wt % to 39.5 wt %, and preferably from 34.5 wt % to 39.5 wt %. The most preferred range is from about 34.5 wt % to 36.5 wt %.

The amount of cobalt should be from 1 wt % to less than 4 wt %. If the amount of cobalt is decreased too much, the thermal expansion coefficient increases. On the other hand, if the amount of cobalt is increased too much, the inflection temperature becomes higher and results in a high thermal expansion coefficient between room temperature and 200° C. For this reason, the amount of cobalt should be from 1 wt % to less than 4 wt %, and preferably from about 1.5 wt % to 3 wt %.

The amount of nickel and cobalt should be below about 41 wt %. If the amount of nickel and cobalt is increased too much, the inflection temperature becomes too high. For this reason, the amount of nickel and cobalt should be below about 41 wt %.

The amount of manganese should be below about 1.5 wt %. The addition of manganese makes the inflection temperature lower. However, if the amount of manganese is increased too much, the thermal expansion coefficient increases. For this reason, the amount of manganese should be maintained below about 1.5 wt %.

The amount of magnesium should be below about 0.1 wt %. The addition of magnesium makes spheroidal graphite crystallize. However, if the amount of magnesium is increased too much, carbide is produced. For this reason, the amount of magnesium should be below about 0.1 wt %.

In regard to this invention, the process is the same as that of an usual cast iron.

EXAMPLE 1

Figure 4:
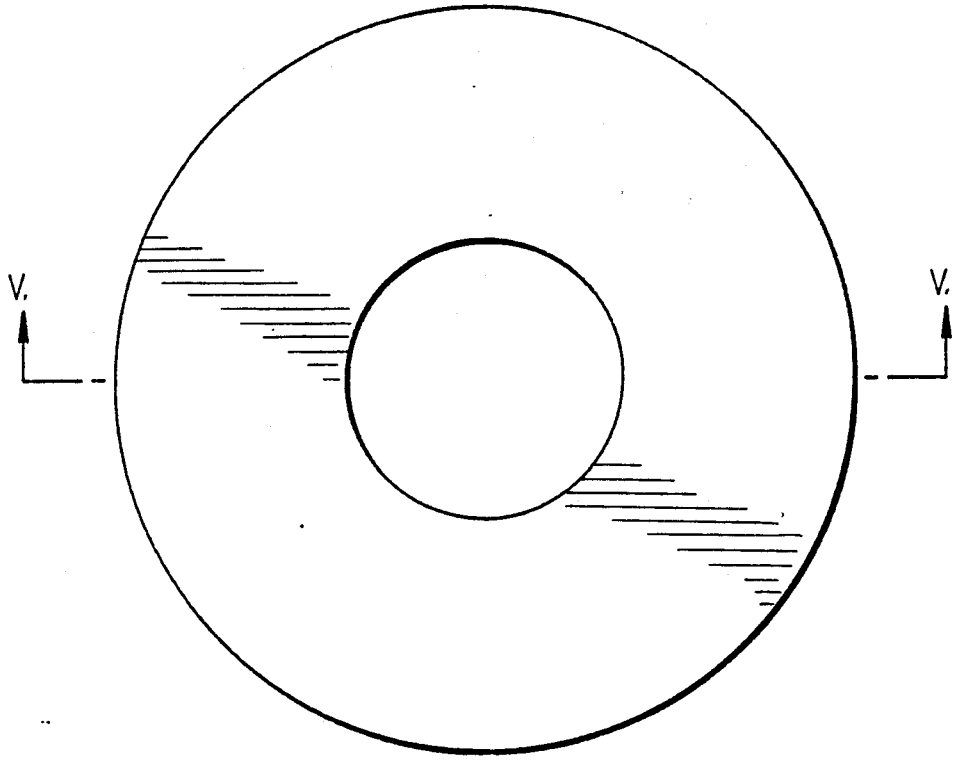
FIG. 4 is a plan view of a lapping tool made with the cast iron of the invention.
Figure 5:
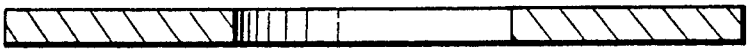
FIG. 5 is a sectional view taken along the lines VI—VI of the tool in FIG. 4.

The lapping tool shown in FIGS. 4 and 5 was cast. This tool had width of 30 mm, an outside diameter of 1000 mm, and an inside diameter of 400 mm.

Table 2 shows the raw materials melted by a high frequency electric furnace.

Table 3 shows that example 1 is a cast iron consisting essentially of 2.32 wt % carbon, 0.57 wt % silicon, 0.24 wt % manganese, 35.2 wt % nickel, 2.6 wt % cobalt, 0.046 wt % magnesium and the balance substantially all iron.

Table 4 shows the measured properties of this tool. In this case, example 1 has a thermal expansion coefficient of $2.0\times10^{-6}$/° C., a tensile strength of 41 kgf/mm$^2$ and an elongation of 20%.

Accuracy is required for lapping tools when the flatness is in a surface roughness range below 20 μm. When usual cast iron is cut by a lathe, heat is produced. This heat makes a temperature difference of from 40° C. to 70° C. between the front face of the lapping tool and the back face of the lapping tool. This makes the flatness worsen to a surface roughness range of from 0.1 mm to 0.2 mm.

When the cast iron of this invention is cut by a lathe, the heat produced makes a temperature difference of from 1° C. to 3° C. between the front face of the lapping tool and the back face of the lapping tool. This is because the cast iron of this invention has low thermal conductivity, good cutting properties and damping capacity. This keeps the flatness in a surface roughness range below 20 μm. For this reason, this invention can be used to make lapping tools for semiconductor substrates.

As stated above, example 1 shows a cast iron having:

(1) an expansion coefficient not greater than $4\times10^{-6}$/° C., and (2) good castability, cutting capability and damping capacity.

In table 4, criteria for evaluation of measured properties were made in comparison with properties of usual cast iron.

EXAMPLE 2

As shown in Table 3, example 2 is a cast iron comprised of 2.8 wt % carbon and 1.0 wt % silicon. This cast iron provides good damping capacity and the same hardness as aluminum alloy. That is to say, its hardness is from 125 HB to 135 HB. Its specific damping capacity is 17%, which is four or five times as high as that of usual cast iron.

EXAMPLE 3

As shown in Table 3, example 3 is a cast iron comprising 1.2 wt % carbon. In this case, crystallization of graphite was noticed, but the amount was not large. Its capacity to be cut was acceptable.

EXAMPLE 4

As shown in Table 3, example 4 is a cast iron comprising 1.0 wt % silicon. In this case, the thermal expansion coefficient was acceptable even though the coefficient was high.

EXAMPLE 5

As shown in Table 3, example 5 is a cast iron comprising 1.2 wt % manganese. In this case, the thermal expansion coefficient was acceptable even though the coefficient was high.

EXAMPLE 6

As shown in Table 3, example 6 is a cast iron comprising 0.8 wt % manganese. In this case, the thermal expansion coefficient was acceptable.

It is believed that many other examples with differing percentages of the specified elements would also have good properties like those of the examples stated above. Such examples are intended to be within the scope of this invention.

COMPARATIVE EXAMPLE 1

As shown in Table 3, comparative example 1 is a cast iron comprising 0.71 wt % carbon. In this case, castability, cutting capability and damping capacity are poor, as shown in Table 4.

COMPARATIVE EXAMPLE 2

As shown in Table 3, comparative example 2 is a cast iron comprising 3.6 wt % carbon. In this case, there are a lot of cast faults in this example, and it has low elongation and low strength, as shown in Table 4.

COMPARATIVE EXAMPLE 3

As shown in Table 3, comparative example 3 is a cast iron comprising 1.7 wt % silicon. In this case, the thermal expansion coefficient is high, as shown in Table 4.

COMPARATIVE EXAMPLE 4

As shown in Table 3, comparative example 4 is a cast iron comprising 31.5 wt % nickel. In this case, the thermal expansion coefficient is high, as shown in Table 4.

COMPARATIVE EXAMPLE 5

As shown in Table 3, comparative example 5 is a cast iron comprising 40 wt % nickel. In this case, the thermal expansion coefficient is high, as shown in Table 4.

COMPARATIVE EXAMPLE 6

As shown in Table 3, comparative example 6 is a cast iron comprising 0.8 wt % cobalt. In this case, the thermal coefficient is high.

COMPARATIVE EXAMPLE 7

As shown in Table 3, comparative example 7 is a cast iron comprising 6.3 wt % cobalt. In this case, the thermal expansion coefficient is high.

COMPARATIVE EXAMPLE 8

As shown in Table 3, comparative example 8 is a cast iron having a combined amount of nickel and cobalt of 42.4 wt %. In this case, the thermal expansion coefficient is high, as shown in Table 4.

As stated above, the cast iron of this invention has both:

(1) an expansion coefficient not greater than $4\times10^{-6}$/° C., and (2) good castability, good cutting properties and good damping capacity.

The present invention has been described with respect to a specific embodiment. However, other embodiments based on the principles of the present invention should be obvious to those of ordinary skill in the art. Such embodiments are intended to be covered by the claims.

TABLE 2

| raw material | composition | rate for melting |
|---|---|---|
| electrolytic nickel | 100% Ni | 37% |
| ductile pig iron | 4.4% C—0.2% Si—0.1% Mn—bal. Fe | 55% |
| cobalt | 100% Co | 2% |
| pure iron | 100% Fe | 4.8% |
| inoculant | Fe—40% Si | 0.2% |
| agent for making spheroidal graphite | Fe—40% Si—7% Mg | 1.0% |

TABLE 3

| | Main composition (%) | | | | | |
|---|---|---|---|---|---|---|
| | C | Si | Mn | Ni | Co | Mg |
| Example 1 | 2.32 | 0.57 | 0.24 | 35.2 | 2.6 | 0.046 |
| Example 2 | 2.8 | 1.0 | 0.2 | 34.5 | 2.8 | — |
| Example 3 | 1.20 | 0.56 | 0.25 | 34.9 | 2.6 | 0.047 |
| Example 4 | 2.30 | 1.4 | 0.30 | 35.7 | 2.3 | 0.052 |
| Example 5 | 2.32 | 0.56 | 1.2 | 34.7 | 2.5 | 0.050 |
| Example 6 | 2.33 | 0.55 | 0.8 | 35.8 | 2.1 | 0.050 |
| Comparative example 1 | 0.71 | 0.60 | 0.30 | 35.0 | 2.4 | 0.050 |
| Comparative example 2 | 3.6 | 1.0 | 0.30 | 35.3 | 2.7 | 0.050 |
| Comparative example 3 | 2.31 | 1.7 | 0.31 | 35.1 | 2.4 | 0.048 |
| Comparative example 4 | 2.32 | 0.56 | 0.30 | 31.5 | 2.6 | 0.050 |
| Comparative example 5 | 2.34 | 0.50 | 0.30 | 40.0 | 2.1 | 0.062 |
| Comparative example 6 | 2.33 | 0.52 | 0.30 | 35.3 | 0.8 | 0.045 |
| Comparative example 7 | 2.33 | 0.54 | 0.25 | 35.7 | 6.3 | 0.048 |
| Comparative example 8 | 2.33 | 0.52 | 0.32 | 38.5 | 4.0 | 0.060 |

TABLE 4

| Properties | Thermal expansion coefficient (0~200° C.) (/°C.) | Tensile strength (kgf/mm²) | Proof stress (kgf/mm²) | Elongation (%) | Young's modulus (kgf/mm²) | Hardness (HB) | Castability | Cutting capacity | Damping capacity |
|---|---|---|---|---|---|---|---|---|---|
| Example 1 | $2.0\times10^{-6}$ | 41.0 | 33.5 | 22 | $9.2\times10^{3}$ | 162 | good | good | good |
| Example 2 | $2.7\times10^{-6}$ | 38.5 | 28.3 | 14 | $9.0\times10^{3}$ | 130 | good | good | very good |
| Example 3 | $2.3\times10^{-6}$ | 60.0 | 55.4 | 16 | $16\times10^{3}$ | 212 | satisfactory | satisfactory | satisfactory |
| Example 4 | $4.0\times10^{-6}$ | 45.0 | 38.7 | 19 | $10\times10^{3}$ | 192 | good | good | good |
| Example 5 | $3.6\times10^{-6}$ | 49.2 | 39.3 | 19 | $10.2\times10^{3}$ | 218 | satisfactory | satisfactory | satisfactory |
| Example 6 | $2.8\times10^{-6}$ | 45.6 | 38.7 | 20 | $10.5\times10^{3}$ | 222 | good | satisfactory | good |
| Comparative example 1 | $2.5\times10^{-6}$ | 62.0 | 57.9 | 18 | $17\times10^{3}$ | 202 | bad | bad | bad |
| Comparative example 2 | $3.5\times10^{-6}$ | 17.2 | 13.2 | 0 | $6.2\times10^{3}$ | 122 | bad | good | good |
| Comparative example 3 | $4.9\times10^{-6}$ | 42.5 | 35.0 | 17 | $9.5\times10^{3}$ | 222 | good | bad | good |
| Comparative example 4 | $4.5\times10^{-6}$ | 43.3 | 20.4 | 21 | $10.6\times10^{3}$ | 162 | good | good | good |
| Comparative example 5 | $5.5\times10^{-6}$ | 47.6 | 35.8 | 20 | $10\times10^{3}$ | 202 | good | good | satisfactory |
| Comparative example 6 | $4.6\times10^{-6}$ | 43.1 | 20.5 | 21 | $10.5\times10^{3}$ | 162 | good | good | good |
| Comparative example 7 | $6.0\times10^{-6}$ | 50.5 | 43.0 | 21 | $12\times10^{3}$ | 222 | good | good | satisfactory |
| Comparative example 8 | $4.4\times10^{-6}$ | 45.5 | 23.0 | 23 | $10.4\times10^{3}$ | 152 | good | good | satisfactory |

What is claimed is:

1. A lapping tool with a surface roughness in a range below 20 μm which is made of at least a cast iron having an austenitic matrix and consisting essentially of from 1 to 3.5% carbon, up to 1.5% silicon, 32 to 39.5% nickel, 1 to less than 4% cobalt, up to 41% of the combined total of nickel plus cobalt and the balance substantially all iron. (% is meant for % by weight).

2. The lapping tool according to claim 1 wherein the cast iron also includes up to 1.5% manganese, and up to 0.1% magnesium.

3. The lapping tool according to claim 1 wherein the amount of silicon is less than 1%.

4. The lapping tool according to claim 1 wherein the carbon is present in a range of about 1.5–3%.

5. The lapping tool according to claim 4 wherein the carbon is present in a range of about 2.2–2.3%.

6. The lapping tool according to claim 3 wherein the amount of silicon is greater than 0.3%.

7. The lapping tool according to claim 1 wherein the amount of nickel is in a range of 34.5–39.5%.

8. The lapping tool according claim 1 wherein the amount of nickel is in a range of 34.5–36.5%.

9. The lapping tool according to claim 1 wherein the amount of cobalt is in a range of 1.5–3%.

* * * * *